United States Patent [19]
Salvagnini
[11] 4,242,898
[45] Jan. 6, 1981

[54] MACHINE FOR BENDING THE EDGES OF RECTANGULAR SHEETS OF METAL

[75] Inventor: Guido Salvagnini, Arzignano, Italy
[73] Assignee: Salvagnini Transferica S.p.A., Sargeo, Italy

[21] Appl. No.: 941,988
[22] Filed: Sep. 13, 1978
[30] Foreign Application Priority Data
Sep. 19, 1977 [IT] Italy ..... 27666 A/77
[51] Int. Cl.³ ..... B21D 5/04
[52] U.S. Cl. ..... 72/307; 72/306; 72/384
[58] Field of Search ..... 72/297, 305, 309, 311, 72/319, 320, 321, 322, 381, 386, 420, 384, 385, 306, 307

[56] References Cited

U.S. PATENT DOCUMENTS

| | | | |
|---|---|---|---|
| 1,387,603 | 8/1921 | McCabe | 72/321 |
| 1,449,427 | 3/1923 | McCabe | 72/321 X |
| 2,734,552 | 2/1956 | Yonash | 72/384 |
| 3,192,759 | 7/1965 | Pelton et al. | 72/319 |
| 3,731,514 | 5/1973 | Deibele, Jr. | 72/411 X |
| 3,786,666 | 1/1974 | York, Jr. | 72/320 |
| 3,802,246 | 4/1974 | Goff | 72/384 |
| 4,092,840 | 6/1978 | Eckhold et al. | 72/321 |

FOREIGN PATENT DOCUMENTS

| | | | |
|---|---|---|---|
| 473224 | 11/1975 | Australia | 72/385 |

*Primary Examiner*—Lowell A. Larson
*Attorney, Agent, or Firm*—George E. Kersey

[57] ABSTRACT

Machine for effecting bends of predetermined width and direction on the edges of a substantially-rectangular sheet of metal, comprises a combination of: a bending press having a C-form support structure carrying a lower bending counterblade, an upper, vertically displaceable blank-holder counterblade, and a pair of vertically displaceable bending blades having respective active parts lying in a common vertical plane substantially coplanar with a rear face of the blank holder counterblade; an iron hand including a vice supported on a carriage movable horizontally, perpendicular to the common vertical plane of the active portions of the bending blades, the lower jaw of the vice being rotatable about a vertical axis and the upper jaw being idle about a vertical axis and displaceable vertically to grasp a sheet to be bent between the jaws; and a positioning programmer, whereby, in use, a sheet of metal gripped by the vice is displaced by a value predetermined by the programmer into a position in which a first side to be bent projects between the counterblades by the desired width of the first bend, the upper blank-holder counterblade being moved vertically downwardly to grip the sheet, and the bending blades are displaced vertically to engage a desired active part thereof against the sheet and bend it in the desired upward or downward direction, the blank-holder counterblade is raised and, the sheet repositioned under control of the programmer and a further bend imparted, this being repeated to effect the required number of bends of desired width and direction on the first side, the sheet is then withdrawn to a position in which rotation of the lower jaw of the vice by a rotator effects rotation of the sheet through 90° or 180° as required to present a further side of the sheet to the bending press, the above actions being repeated to effect desired bending of each side.

18 Claims, 5 Drawing Figures

MACHINE FOR BENDING THE EDGES OF RECTANGULAR SHEETS OF METAL

BACKGROUND OF THE INVENTION

The present invention relates to a machine for bending the edges of substantially rectangular sheets of metal. More particularly, the invention relates to a machine, equipped with a single bending press, which can be used to bend each of the edges of a rectangular sheet of metal one or more times to form a panel; such panels are widely used, for example, in the manufacture of metal furniture, refrigerators, washing machines, air conditioners and shelving in general.

Until now the peripheral bending of sheet metal to obtain such panels has been effected by known bending presses, incorporating plate-forming dies, which have a recognised technical and economic drawback due to the need for manual intervention by one or more operatives in all the successive stages of production of a panel. Thus, a sheet to be worked must be fed manually to, and correctly positioned on, the work table of the press and any subsequent repositioning of the sheet to present different sides of the sheet to the bending die, or to turn the sheet over to effect bending in the opposite direction must also be effected manually. The removal of the bent panel from the press must also be carried out by hand.

Such manual intervention not only lowers the overall production efficiency of the bending process compared with that potentially achievable, but also increases the probability of dimensional and/or geometric errors in the finished panels. These disadvantages clearly assume greater importance the larger the number of bends required on each side of a panel and the greater the number of sides to be bent.

The object of the present invention is to provide a machine which although equipped with only a single bending press, is capable of effecting bending of a rectangular sheet to provide a plurality of bends of predetermined amplitude and direction on each of the four sides without any manual intervention.

SUMMARY OF THE INVENTION

According to the present invention there is provided a machine for effecting bends of predetermined width and direction on the edges of a substantially-rectangular sheet of metal, wherein the machine comprises a combination of: a bending press having: a support structure of essentially C-form vertical section with horizontally extending upper and lower support arms, a bending counterblade carried by said lower support arm, a blank holder counterblade supported by said upper support arm, blank holder counterblade guide means for guiding said blank holder counterblade for vertical displacements, a pair of bending blades supported between said upper and lower support arms and having respective active parts, lying in a common vertical plane extending axially of said C-form support structure, bending-blade guide means for guiding said bending-blades for vertical displacement, respective drive means for driving said vertical displacements of said blank-holder counterblade and of said bending-blades; and an iron hand including: a carriage movable along a horizontal line perpendicular to said common vertical plane of said active portions of the said bending blades, carriage guide means for guiding said movements of said carriage, a vice supported by the said carriage for translational movement therewith, said vice having an upper jaw and a lower jaw, disposed with respect to each other about a vertical axis for grasping a said sheet of metal between them, said upper jaw being carried in idling fashion about said vertical axis and being displaceable along said vertical axis, said lower jaw of said vice being supported for rotation about said vertical axis in either sense, first motor means for driving movements of said carriage along said line of action in each direction, second motor means for driving vertical displacements of said upper jaw, and a rotator for driving said rotation of said lower jaw about said vertical axis, a positioning programmer for controlling said carriage to undergo displacements along said line of action, of predetermined value in dependance on said predetermined amplitude of said bends which it is intended to carry out on each side of said sheet of metal, whereby in use of said machine a sheet of metal placed between said upper and lower jaws of said vice is gripped by said jaws on downward displacement of said upper jaw, under the action of said second motor means, into contact with said sheet to support said sheet from said carriage; said sheet is displaced by a predetermined value into a position in which an edge portion thereof to be bent is located between said upper and said lower arm of said support structure, by movement of said carriage controlled by said positioning programmer; said blank-holder counterblade is displaced vertically downwardly to grip said sheet between the blank-holder counterblade and said bending counterblade; a desired one of said pair of bending blades is displaced vertically into contact with said edge portion of said sheet to effect the required bending, the lower blade of said pair of bending blades being displaced vertically upwardly to effect upward said bending, the upper blade of said pair of bending blades being displaced vertically downwardly to effect downward said bending; the sheet is released from engagement with said support structure by vertical displacement of said bending blade which has effected bending and of said blank-holder counterblade out of contact with the sheet and, if further bending of that edge is required, the above actions starting from displacement of the carriage are repeated until all the required bending has been effected; the sheet is then released from engagement with said support structure and displaced, by movement of said carriage into a position spaced from said support structure in which rotation of said lower jaw, under the action of said rotator, rotates the sheet to present a further edge towards the support structure, all the above actions then being repeated to effect bending of said further edge and of the other two unbent edges as required.

BRIEF DESCRIPTION OF THE DRAWINGS

One embodiment of the invention will now be more particularly described by way of example with reference to the accompanying purely diagrammatic drawings, in which.

DESCRIPTION OF THE PREFERRED EMBODIMENT

Figure 1:
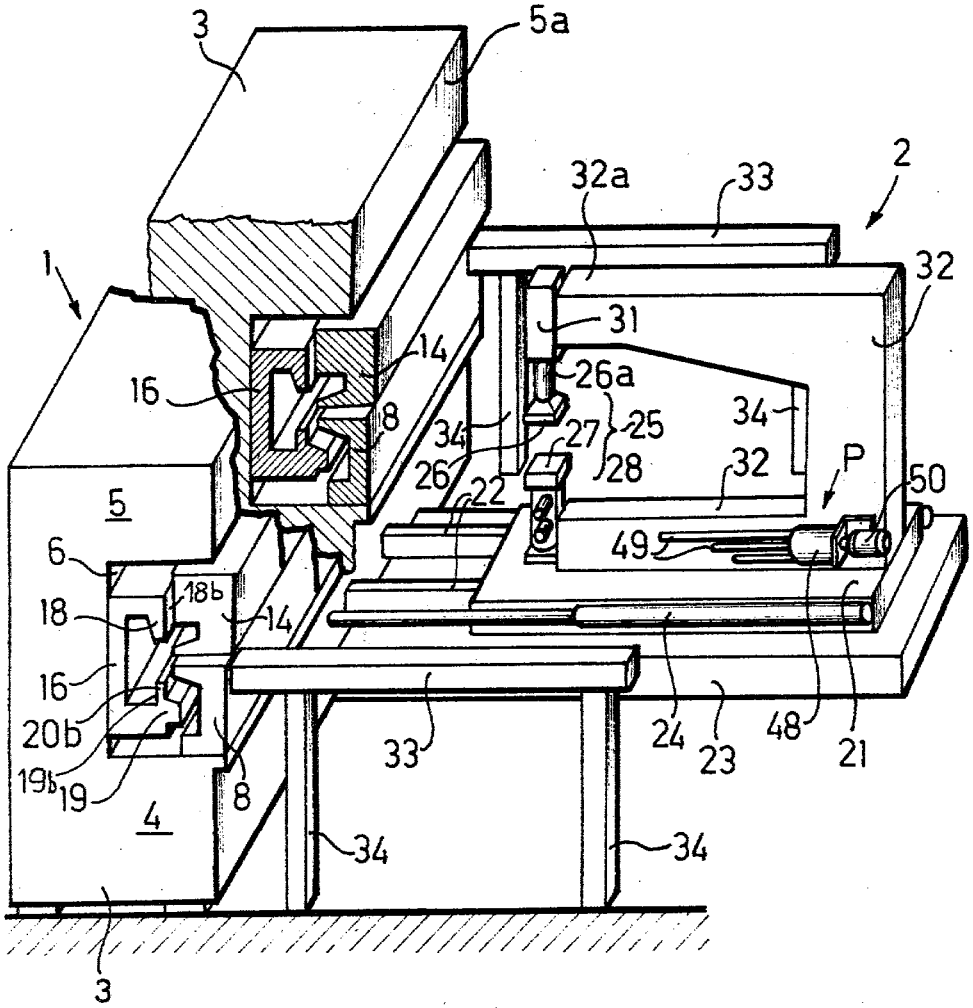
FIG. 1 is a partially-sectioned, perspective view of a machine according to the invention.
Figure 2:
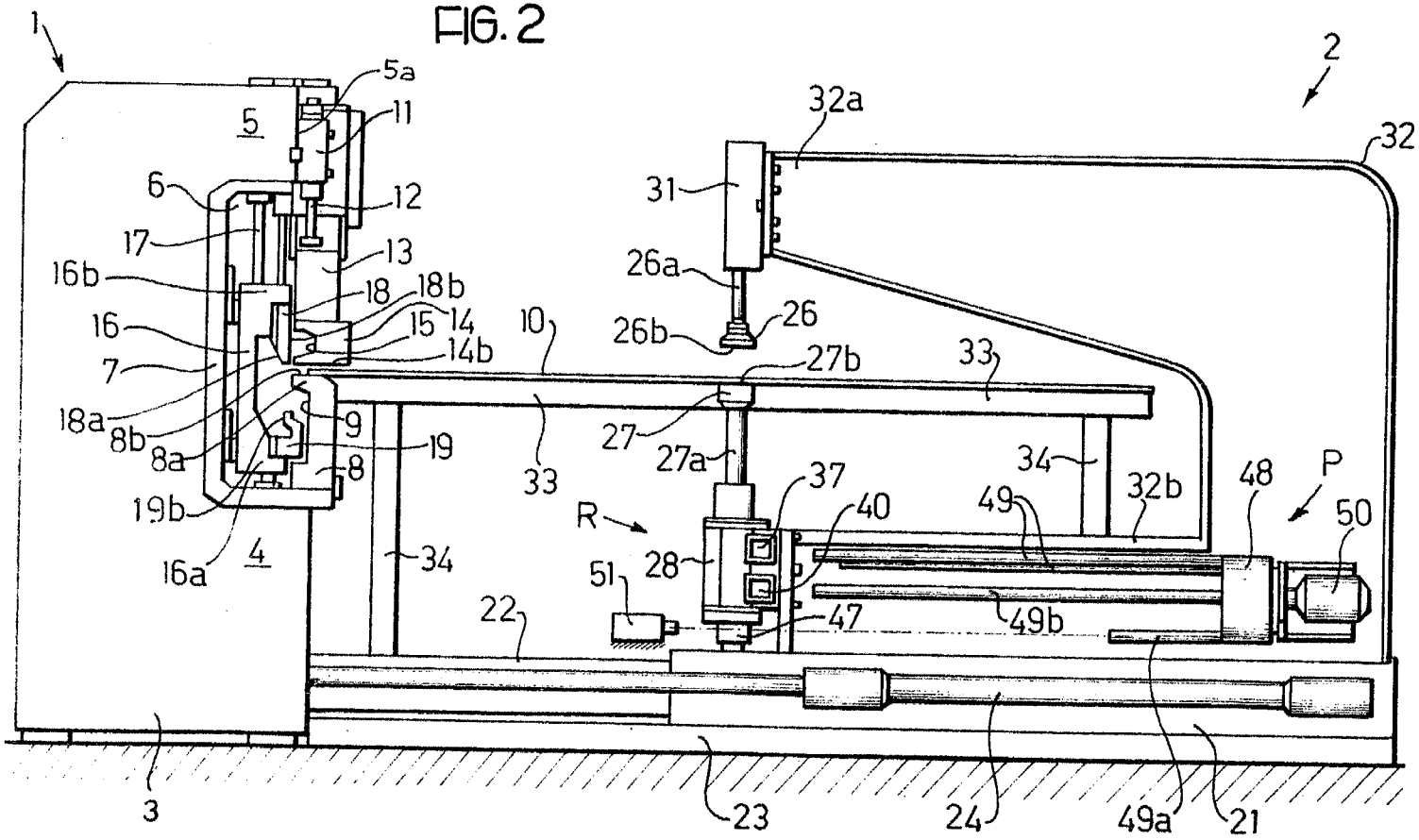
FIG. 2 is a side view, on an enlarged scale, of the machine of FIG. 1.

Referring to FIGS. 1 and 2 of the drawings, a machine according to the invention, for bending the edges of rectangular metal sheets to form panels is shown and consists essentially of a bending press generally indicated 1 and an iron hand generally indicated 2 on which are mounted a positioning programmer P and a rotator R.

The bending press 1 includes a support structure 3 having a generally C-shape cross-section in a vertical plane, an upper arm 5 and a lower arm 4 of the C-shape projecting forwardly and horizontally from a vertical support and being spaced from each other at a fixed distance. The said support and arms 4 and 5 define between them a space 6, the walls of the support and arms 4, 5 facing into the space 6 being completely covered by a C-shaped stiffening plate 7.

An elongate support 8, which constitutes a bending counterblade, is fixed to the upper face of the outermost edge-portion of the lower arm 4 by conventional means that are not shown, the support 8 having a flat upper support surface 8*b*. The wall of the counterblade 8 facing into the space 6 is formed with a longitudinally extending channel 9, bounded on its upper side by a projecting portion 8*a* of the counterblade.

The length of the projection 8*a* and the depth of the channel 9 are predetermined in dependence on the bending which it is desired to effect by a particular machine.

The upper arm 5 of the support structure 3 carries a plurality of double-acting fluid-pressure actuators 11 which are attached to it by conventional means (not illustrated) with their axes vertical. The lower ends of the respective shafts 12 of the actuators 11 are all connected in a conventional manner to a single horizontal bar 13, which extends axially of the structure 3. To the lower end of this bar 13 is releasably fixed a blank-holder counterblade 14, the lower surface 14*b* of which is planar and horizontal and faces the upper surface 8*b* of the counterblade 8.

The wall of the counterblade 14 facing into the space 6, is formed with a longitudinal channel 15 the dimensions of which, like those of the channel 9, are predetermined according to the bending to be carried out.

Within the space 6 is supported a rigid cutter-block 16, also of essentially C-shape vertical cross-section, with horizontal lower and upper arms 16*a*, 16*b*, respectively, each extending towards a respective counterblade 8, 14. The said cutter-block 16 is slidably mounted on a plurality of vertical, feed guide rods 17, fixed in a conventional manner, not shown, between the arms 4, 5 of the support structure 3, the cutter-block 16 being displaceable by fluid-pressure means, which are not shown for clarity in the drawing, on the guide rods which guide it for vertical movement.

To the upper arm 16*b* of the cutter-block 16 is releasably fixed, by conventional means, a bending blade 18, an active portion 18*a* of which has a vertical face 18*b*, facing outwardly from the space 6. The outer face of the active part 18*b* is almost flush with and arranged to cooperate with the inwardly facing walls of the blank-holder counterblade 14.

A further bending blade 19, is fixed, again by conventional means to the lower arm 16*a* of the cutter-block 16. The blade 19 is also formed to cooperate with the bending counterblade 14, having an upper, active portion 20*b* with an outwardly facing vertical surface for cooperating with the inwardly facing wall of the counterblade 14.

The iron hand 2 of the machine includes a carriage, generally indicated 21, movable on horizontal, rectilinear guides 22, supported by a base plate 23 and extending perpendicular to the axis of the support structure 3. The said carriage 21 is displaceable in either direction along the guides 22 by means of two fluid-pressure actuators 24 arranged with their axes horizontal.

The iron hand 2 also includes a vice, generally indicated 25, supported by the chassis of the carriage 21, for translational movement therewith. The vice 25 has two jaws 26, 27 the upper jaw 26 of which is vertically disposed above the lower jaw 27 such that, planar, horizontal jaw faces 26*b*, 27*b* of the jaws 26, 27 respectively are opposed to each other.

The lower jaw 27 is integral with a vertical shaft 27*a*, supported for rotation about its own vertical axis in a casing 28. Within the casing 28 is housed a rotator R arranged to rotate the shaft 27*a* about its axis through an angle of 90° or 180° in either sense.

Figure 3:
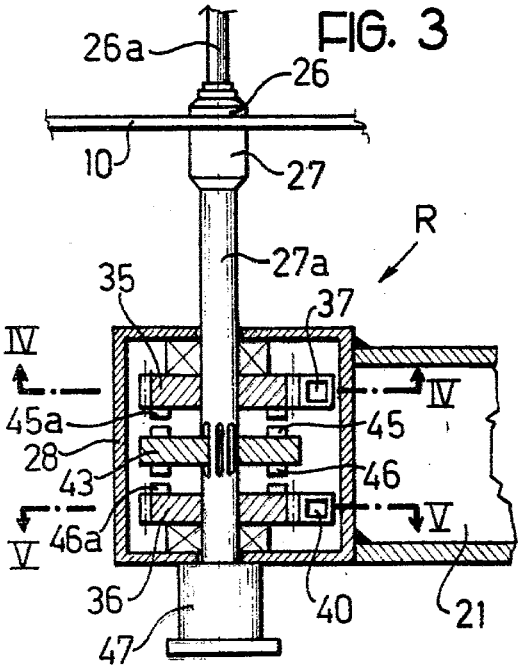
FIG. 3 is a sectional view, on an enlarged scale, of a rotator forming part of the machine of FIG. 1.
Figure 4:
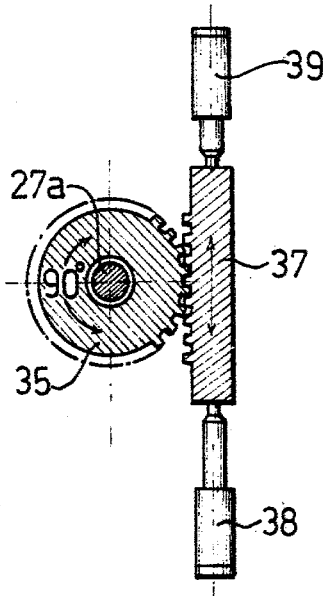
FIGS. 4 and 5 are sectional views taken on lines IV—IV and V—V respectively of FIG. 3.
Figure 5:
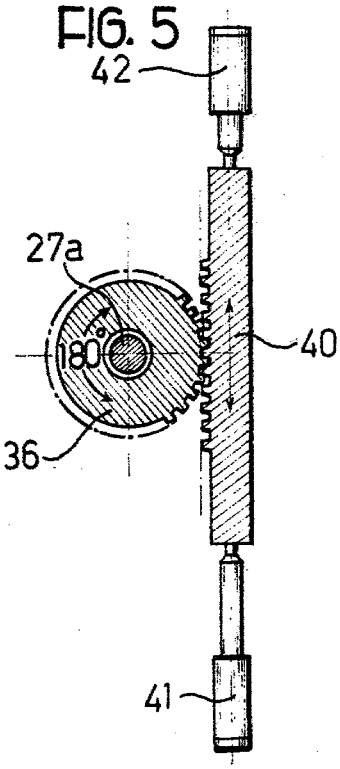

In particular, with reference to FIGS. 3, 4 and 5 of the drawings, the rotator R includes two pinions 35, 36 supported in the casing 28, coaxial with, but idling with respect to, the shaft 27*a*, the pinion 35 being located above and spaced from the pinion 36. The teeth of the pinion 35 and the pinion 36 are engaged with the teeth of respective horizontal racks 37, 40, which are controlled for axial displacement, each by two fluid-pressure actuators 38, 39, 41, 42, respectively with shock absorbers. The actuators 38, 39 and the rack 37 are so arranged that axial displacement of the rack 37 results in an angular displacement of the pinion 35 through 90° in a sense depending on the direction of movement of the rack. The cylinders 41, 42 and the rack 40, on the other hand are so arranged that axial displacement of the rack 40 results in an angular displacement of the pinion 36 through 180°, again in a sense depending on the direction of movement of the rack.

Between the pinions 35 and 36, and axially coupled with the shaft 27*a*, is a disc 43 provided with a plurality of coupling teeth 45, 46 angularly spaced around the disc: the teeth 45 are located on the upper face for coupling with cooperating teeth 45*a* on the lower face of the pinion 35, while the teeth 46 are located on the lower face of the disc 43 for coupling with cooperating teeth 46*a* provided on the upper face of the pinion 36. The disc 43 is displaceable vertically with respect to the shaft 27*a*, from the position shown in FIG. 3, by means of a double-acting pneumatic cylinder 47, supported below the casing 28, with its axis vertical. The action of the cylinder 47 displaces the disc 43 either upwardly, such that the teeth 45 and 45*a* interengage to lock the shaft 27*a* to the pinion 35 for rotation therewith, or downwardly, such that the teeth 46, 46*a* interengage to lock the shaft 27*a* for rotation with the pinion 36. Thus the shaft 27*a* may be rotated through 90°, with the pinion 35, or through 180° with the pinion 36 as required.

Referring to FIGS. 1 and 2, the upper jaw 26 of the vice 25 is integral with a vertical shaft 26*a*, which comprises the shaft of a double-acting, vertical-axis cylinder-piston unit 31. The jaw 26 is thus displaceable vertically by means of the piston unit 31, and can be lowered to clamp a sheet 10 of metal to be worked in the machine between the jaws 26, 27. The unit 31 is supported at the free end 32*a* of a horizontally extending arm of a bracket 32, the foot 32*b* of which is rigidly fixed to the carriage 21, for translation therewith. The shaft 26*a* and hence the upper jaw 26, idles about its vertical axis and is angularly displaceable in the vertical plane parallel to the axis of the horizontal arm of the bracket 32, to compensate for distortion of the arm when the jaws 26, 27 are clamped on to a sheet 10 to be manipulated.

The programmer P of the machine is a positioning programmer for determining displacements of the carriage 21 along the guides 22. The programmer P comprises essentially a drum 48 supported by the carriage 21 laterally of the bracket 32, with its axis horizontal and perpendicular to the axis of the support structure 3. The drum 48 has a plurality of seats formed in its circular face facing the structure 3, the seats being substantially equiangularly spaced around the said face. The number of seats depends on the maximum number, n of bends that may be carried out on one side of the sheet 10, the drum 48 having a number of seats equal to: $4(n+1)$.

In each of the seats of the drum 48 is fixed a cylindrical rod 49; the rods 49 have respective predetermined lengths and project from the drum towards the bending press 1. A stepping motor for rotating the drum 48 about its horizontal axis is shown schematically at 50 whilst a shock-absorber brake arranged to cooperate with the free end of one of the rods 49 which is aligned with it (in FIG. 2 this rod is shown by the number 49*a*), is shown schematically as 51.

Between the support structure 3 and the carriage 21 are a number of horizontal boxed girders 33 (only two are shown for clarity in the drawings), supported by respective legs 34, which form a horizontal bearing plane, located at the same height as the upper surface 8*b* of the bending counterblade 8 and of the jaw face 27*b* of the lower jaw 27 of the hydraulic vice 25.

OPERATION

The operation of the machine described above is as follows.

A sheet of metal 10 is fed automatically, for example by means of a transporter of conventional type, preferably a magnetic transporter of the type described in Italian Pat. No. 1,015,136 by the same Applicant, onto the bearing plane formed by the boxed girders 33. Here it is automatically positioned and centred such that a first edge to be bent in the machine is closest to and parallel to the axis of the support structure 3 by means of a plurality of conventional pushers (not shown) and a plurality of withdrawable jig locators, also of a conventional type and not shown, with which the machine is equipped.

Once the sheet 10 has been positioned, the upper jaw 26 of the vice 25 is lowered by operation of the cylinder unit 31 into engagement with the sheet 10 and presses the sheet against the lower jaw 27 of the vice. The whole iron hand 2 is then moved by operation of the fluid-pressure actuators 24 towards the support structure 3 and is halted when the free end of the rod 49*a* abuts the shock-absorber brake 51. At this point the sheet 10 is located between the opposed surfaces 8*b* and 14*b* of the counterblades 8 and 14 respectively with the first side projecting into the space 6 by a depth which is exactly equal to a predetermined width of the first bend which it is desired to effect on the edge of the plate 10.

By operation of the plurality of actuators 11, the blank-holder counterblade 14 is next lowered so as to clamp the sheet 10 firmly against the counterblade 8. The first required bend is then effected by displacement of the cutter-block 16 vertically in the desired direction, that is, either upwardly or downwardly, according to the predetermined direction which it is intended to impart to the bend itself, in accordance with a pre-established programme. The active portion of the corresponding bending blade 18 or 19 is thus engaged against the edge portion of the plate adjacent the said first side to bend it downwardly or upwardly respectively.

During the bending stage, the programmer P, by means of rotation of the drum 48 controlled by the stepping motor 50, brings a further rod 49*b*, shorter than and circumferentially adjacent the rod 49*a*, into alignment with the shock-absorber brake 51.

In order to carry out a subsequent bend on the said first side of the sheet 10 which has now already been bent once the counterblade 14 is lifted a little, still by operation of the plurality of cylinders 11, and the iron hand 2 is made to advance towards the support structure 3 until the free end of the rod 49*b* abuts the shock-absorber brake 51; the displacement towards the bending press will be equal to the difference between the lengths of the rods 49*a* and 49*b* and this is arranged to be the required width of the second bend.

The counterblade 14 is again lowered to clamp the sheet 10 against the counterblade 8 and the cutter-block 16 is moved vertically to effect the second bend in the desired direction.

Further bends, oriented at 90° to one another, may be effected on the said first side of the sheet by repetition of the above steps starting from rotation of the drum 48 to bring a further rod 49 into alignment with the brake 51.

Once the required number of bends (for example 5 bends) have been effected on the first side of the sheet 10, the counterblade 14 is raised and the iron hand is moved away from the press by operation of the actuators 24. The shaft 27*a* is then engaged with the pinion 35 or 36 by axial displacement of the disc 43 and the corresponding rack 37 or 40 is displaced to cause a desired rotation of the shaft 27*a*, and hence of the jaw 26, carried in idling manner for rotation, and the sheet 10 clamped between them, through 90° or 180°, the rack having previously been arranged to rotate the sheet in a desired sense. A second side of the sheet 10 is thus presented towards the bending press 1. This second side is now subjected to bending by repetition of the operations described above in relation to the first side.

At this point it must be specified that the short sides of the sheet 10 must first be subjected to bending, the longer sides being bent subsequently. Moreover, since, after the execution of bends on one long side of the sheet 10, the panel obtained completely wraps around the blank-holder counterblade 15, this counterblade 14 must be of a type known in the art (contractable type counterblade) which is formed from a plurality of metal sections that can be drawn together or apart to allow the extraction of the panel.

When the bending operations have been completed on all four sides of the sheet 10, the iron hand 2 is withdrawn by the cylinders 24 to its original position, where, after the opening of the vice 25, the panel is removed by the magnetic transporter which fed it to the machine initially.

The above machine according to the present invention can thus bend all four sides of a rectangular sheet 10 with which it is fed, according to a predetermined programme, without any manual intervention. The only manual operation which may be necessary is that of lifting the sheet 10 from a pack of sheets and positioning it on the magnetic transporter.

In the machine of this invention, the use of shock-absorber brakes of the type described in Italian Pat. No. 978,254 by the same applicant is particularly advantageous.

The operative cycle of the above machine is a sequential cycle, that is, it is composed of successive stages each of which is carried out only when the preceding one has been completed.

I claim:

1. A machine for effecting bends of predetermined width and direction on the edges of a substantially rectangular sheet of metal, which comprises a bending press comprising a support structure of essentially C-form having a vertical section with horizontally extending upper and lower support arms, a bending counterblade carried by the lower support arm, a blank holder counterblade supported from the upper support arm, means for guiding said blank-holder counterblade for vertical displacements, a pair of bending blades supported between said upper and lower support arms and having respective active parts lying in a common vertical plane extending axially of said C-form support structure, means for guiding said bending blades for vertical displacement, and respective means for driving said vertical displacements of said blank-holder counterblade and of said bending-blades;

an iron hand comprising a carriage movable along a horizontal line perpendicular to said common vertical plane of said active parts of said bending blades, means for guiding movements of said carriage, a vise supported by said carriage for translational movement therewith, said vise having an upper jaw and a lower jaw disposed with respect to each other about a vertical axis, said upper jaw being carried in idling fashion about said vertical axis, to grasp said sheet of metal between said upper and lower jaws, said lower jaw of said vise being supported for rotation about said vertical axis in either sense, first motor means for driving movements of said carriage along said horizontal line in either direction, a second motor means for driving vertical displacements of said upper jaw, and means for rotating said lower jaw about said vertical axis; and a positioning programmer for controlling said carriage to undergo displacements along said horizontal line, of predetermined value in dependence of said predetermined width of said bends to be carried out on a side of said sheet of metal.

2. The machine of claim 1, wherein said rotator includes:

a casing, carried by said carriage, a vertical shaft supported in said casing for rotation about its longitudinal axis, two pinions supported in said casing, coaxially with and idling with respect to said shaft, and spaced apart along said shaft, two horizontal rectilinear racks, supported in said casing such engaged with a respective one of said pinions, motor means for driving axial displacements of said racks, said two racks being arranged, on operation of said motor means to cause rotation of the respective pinions, one pinion through an angle of 90° and the other pinion through an angle of 180°, in either sense, a disc mounted coaxially on and axially coupled to said shaft between said two pinions, a set of teeth provided one set on each of said two pinions on a respective face opposing said disc, two sets of teeth provided one set on each face of said disc for engaging a respective set of teeth of said two pinions, drive means for driving vertical displacements of said disc to engage a set of teeth of said disc with a cooperating set of teeth of one of said two pinions to lock the disc, and hence said shaft, to said one of said pinions for rotation therewith.

3. The machine of claim 1, wherein said positioning programmer includes:

a drum carried by said carriage with axis parallel to the displacement of said carriage;

a stepping motor for driving angular displacements of said drum about said axis, a plurality of rectilinear rods supported by said drum and projecting parallel to said axis of said drum, towards said support structure, each of said rods having a respective predetermined length, a shock-absorber brake arranged to cooperate in programmed succession with each of said rods to stop the movement of said carriage along said line of action towards said support structure.

4. A machine for effecting a bend of predetermined width and direction on an edge of sheet metal, comprising a support structure with outwardly extending and oppositely positioned support arms;

a bending counterblade carried by one of the support arms;

a blank-holder counterblade supported by the other support arm and driven for movement relative to said bending counterblade;

and oppositely positioned bending blades supported between said support arms and connected for unitary movement relative to the counterblades, said bending blades cooperating with said bending counterblade and said blank-holder counterblade for bending an edge of a metal sheet clamped by said counterblades.

5. A machine for effecting a bend of predetermined width and direction on an edge of a sheet of metal, comprising a support structure with outwardly extending support arms; a bending counterblade carried by one of the support arms and driveable relative to the first support arm; and a cutter block slidably mounted on fixed guides between said support arms and driveable relative thereto;

said cutter block having a cross section with arms extending towards said bending counterblade and said blank-holder counterblade; the arms of said cutter block carrying releasably fixed bending blades which cooperate with said bending counterblade and said blank-holder counterblade for bending an edge of a metal sheet clamped by said counterblades in respective opposite directions.

6. A machine for effecting a bend of predetermined width and direction on an edge of a sheet metal, comprising a bending press formed by support structure with outwardly extending upper and lower support arms, a bending counterblade carried by the lower support arm, a blank-holder counterblade supported by the upper support arm and driven for vertical movements, and an upper bending blade and a lower bending blade supported between said support arms and driven for vertical movements, said upper and lower bending blades cooperating with said bending counterblade and said blank-holder counterblade for respectively downwardly and upwardly bending an edge of a sheet of metal clamped by the counterblades;

an iron hand formed by a carriage movable on rectilinear guides extending perpendicular to the axis of said support structure, a vise supported by said carriage for translational movement therewith, said vise having an upper and a lower jaw for clamping a metal sheet, and a rotator for displacing at least one of the jaws about a vertical axis; and a positioning programmer for controlling the displacements of said carriage along said rectilinear guides in dependence on the predetermined wideth of the bend which is to be carried out on the edge of said sheet of metal.

7. The machine of claim 6 wherein the lower jaw of said vise is fixed at the upper end of a vertical shaft supported by said carriage and driven by said rotator for angular displacements about its longitudinal axis.

8. The machine of claim 7 wherein said rotator comprises a casing on said carriage and pivotally bearing said vertical shaft, two pinions coaxially supported in said casing on said shaft and spaced apart therealong, two horizontal rectilinear racks, supported in said casing and engaging respective ones of said pinions, means for displacing said racks, each being arranged, on operation of the displacing means to cause rotation of the respective pinions one through an angle of 90° and the other through an angle of 180°, in either sense, a disc mounted coaxially on and axially coupled to said shaft between said two pinions, a set of teeth provided on each of said two pinions on respective faces opposite said disc, two sets of teeth on said disc for engaging the respective sets of teeth of said two pinions, and means for displacing said disc upwardly to engage a set of teeth of said disc with a cooperating set of teeth of one of said two pinions to lock the disc, and hence said shaft, to said one of said pinions for rotation therewith.

9. The machine of claim 6 wherein said positioning programmer comprises a drum carried by said carriage with its axis parallel to the displacement thereof;

a stepping motor for angularly displacing said drum about said axis;

a plurality of rectilinear rods supported by said drum and projecting parallel to said axis of said drum towards said support structure, each of said rods being a predetermined length; and a shock absorber braker arranged to cooperate in programmed succession with one of said rods, with which it is aligned, to stop the movement of said carriage along said rectilinear guides.

10. Apparatus for bending the edge of a sheet of metal blank comprising a pair of holders that are relatively movable between an open position, with an elongated gap therebetween, and a closed position, where a sheet metal blank is engageable therebetween;

means for positioning the sheet metal blank between said pair of movable holders, with the portion of the sheet metal blank to be bent extending therefrom;

an elongated bending block having a generally open cross section defining an elongated gap, disposed in close proximity to said pair of movable holders, to receive the portion of the sheet metal blank that is to be bent; and means connected to said elongated bending block for moving said block with respect to said holders to bend a portion of the sheet metal blank.

11. Apparatus as defined in claim 10 wherein the sheet metal blank positioning means comprises means for rotating the sheet metal blank about a vertical axis to a selected position; and a positioning programmer for moving the sheet metal blank in a horizontal plane into the elongated bending block a predetermined distance determined by the width of the desired bend.

12. A bending press having an elongated front for receiving a portion of a sheet metal blank that is to be bent, comprising a frame supporting a pair of holders which are relatively movable between an open position, where the holders are spaced apart, and a closed position where the sheet metal blank is held during bending;

a pair of spaced-apart and elongated bending blades comprising an elongated C-shaped block, disposed behind a pair of holders and having upper and lower arms extending toward said holders, with one of said elongated blades attached to the upper arm and the other bending blade attached to the lower arm, said arms defining a gap therebetween into which extends the part of the sheet metal blank which is to be bent; and means for moving either of the bending blades into engagement with the sheet metal blank to form a bend in the desired direction.

13. A bending press having an elongated front for receiving a portion of a sheet metal blank which is to be bent, comprising a frame supporting a pair of holders which are relatively movable between an open position, where the holders are spaced apart, and a closed position where the sheet metal blank is held during bending;

a pair of spaced-apart and elongated blades rigidly connected for unitary movement behind said pair of holders and defining a gap therebetween into which extends the part of the sheet metal blank which is to be bent; and means for moving either of the bending blades into engagement with the sheet metal blank by forming a bend in the directed direction.

14. A machine for making multiple bends in a sheet metal blank comprising a support structure;

a first elongated counterblade mounted on said support structure and having a longitudinal channel formed therein into which a portion of a completed bend can extend;

a second elongated counterblade mounted on said support structure and being movable with respect to said first elongated counterblade between an open position, with a gap between blades, and a closed position, where the sheet metal blank is clamped with a portion of a completed bend extendable into a longitudinal channel formed therein;

a pair of elongated bending blades, which are joined together for unitary movement, mounted on said support structure in close and parallel proximity to the first and second elongated counterblades, said pair of bending blades being spaced apart and movable in a generally vertical plane; and means for moving one of the elongated bending blades in an upward direction to bend upwardly a portion of the clamped sheet metal blank and for moving the other elongated bending blade in a downwardly direction to bend downwardly a portion of the clamped sheet metal.

15. A machine as defined in claim 14 comprising a position programmer for moving the blank along a horizontal axis into a gap between said first elongated counterblade and said second counterblade a distance determined by the width of the desired bend; and means for angularly moving the sheet metal blank around a vertical axis so that said position programmer can move different edges of the sheet metal blank into position for being bent.

16. A method of making multiple bends on edges of a sheet metal blank in a bending press, comprising the steps of:

(a) positioning on a bending press an elongated bending block having a generally open cross section and an upper bending blade and a lower bending blade secured thereto;

(b) securing the sheet metal blank in clamping means of the bending press with the portion of the sheet metal blank to be bent extending therefrom between the upper bending blade and the lower bending blade and into the open cross section of the bending block;

(c) moving the bending block with respect to the clamping means to bend the poriton of the sheet metal blank extending into the bending block with respect to the rest of the sheet metal blank; and (d) repeating steps (b) through (c) until all desired bends are made in the sheet metal blank.

17. A method for making multiple bends on edges of a rectangular sheet metal blank in a bending press having a pair of elongaed holders for clamping the sheet metal blank in a horizontal plane and a pair of bending blades that are movable up and down in a vertical plan to bend a portion of the sheet metal blank extending from the blank holders, comprising the steps of:

(a) orienting the sheet metal blank with one of its short sides in proximity and parallel with the pair of holders;

(b) feeding the sheet metal blank into the holders so that the portion of the endge to be bent extends therefrom;

(c) closing the holders to clamp the sheet metal blank in place;

(d) moving the bending blades to make a desired bend in the sheet metal blank;

(e) releasing the holders to free the sheet metal blank;

(f) repeating steps (b) through (e) until all desired bends on the short side are made;

(g) orienting the sheet metal blank with the other short side in proximity and parallel to the pair of holders;

(h) repeating steps (b) through (e) until all bends on the other short side are made;

(i) orienting the sheet metal blank with one of the long sides in proximity and parallel to the pair of holders;

(j) repeating steps (b) through (e) until all bends on the long side are made;

(k) orienting the sheet metal blank with the other long side in proximity and parallel to the pair of holders; and (l) repeating steps (b) through (e) until all bends on the other long side are made.

18. A machine for bending a sheet of material, comprising an integral support structure with outwardly extending support arms;

a bending counterblade positioned on one of the support arms;

a blank-holder counterblade positioned on the other support arm;

said bending and blank-holder counterblades being movable relative to one another;

a unitary bending structure positioned between said support arms and movable relative to said counterblades;

thereby to permit said material to be bent during successive movements of said unitary bending structure relative to said counterblades.

* * * * *